US011807970B2

(12) United States Patent
Brundage

(10) Patent No.: US 11,807,970 B2
(45) Date of Patent: Nov. 7, 2023

(54) METHODS, SYSTEMS, AND APPARATUSES FOR THREADING NEEDLES

(71) Applicant: Natasha Brundage, Atlanta, GA (US)

(72) Inventor: Natasha Brundage, Atlanta, GA (US)

( * ) Notice: Subject to any disclaimer, the term of this patent is extended or adjusted under 35 U.S.C. 154(b) by 156 days.

(21) Appl. No.: 17/323,610

(22) Filed: May 18, 2021

(65) Prior Publication Data

US 2021/0355618 A1 Nov. 18, 2021

Related U.S. Application Data

(60) Provisional application No. 63/026,520, filed on May 18, 2020.

(51) Int. Cl.
*D05B 87/02* (2006.01)
*D05B 3/12* (2006.01)
*A41G 5/00* (2006.01)

(52) U.S. Cl.
CPC ..... *D05B 87/02* (2013.01); *D05B 3/12* (2013.01)

(58) Field of Classification Search
CPC ..... D05B 87/00; D05B 87/02; D05B 3/12; A41G 5/0053; A41G 5/0086
USPC ..... 112/224
See application file for complete search history.

(56) References Cited

U.S. PATENT DOCUMENTS

| | | | | |
|---|---|---|---|---|
| 2,679,959 | A * | 6/1954 | Ullisperger, Sr. | D05B 87/00 108/69 |
| 4,913,325 | A * | 4/1990 | Cacicedo | D05B 87/02 223/102 |
| 6,045,016 | A * | 4/2000 | Okada | D05B 87/00 112/225 |
| 2004/0026470 | A1* | 2/2004 | Tanaka | D05B 87/00 223/99 |

FOREIGN PATENT DOCUMENTS

JP 2000051561 A * 2/2000

* cited by examiner

*Primary Examiner* — Patrick J. Lynch
(74) *Attorney, Agent, or Firm* — Ballard Spahr LLP

(57) ABSTRACT

A device may be used to selectively and automatically thread one or more needles, such as hair sewing/weaving needles. A threader arm of a plurality of threader arms may be selected via an interface. The selected threader arm may be configured to push a portion of a thread through an eye of a needle received at a needle receptacle associated with the selected threader arm.

17 Claims, 4 Drawing Sheets

METHODS, SYSTEMS, AND APPARATUSES FOR THREADING NEEDLES

CROSS-REFERENCE TO RELATED PATENT APPLICATION

This application claims priority to U.S. Provisional Application No. 63/026,520 filed May 18, 2020, herein incorporated by reference in its entirety.

BACKGROUND

Hair extensions are used to enhance the thickness, fullness, and length of hair. Hair extensions are applied to hair based on techniques that include gluing, braiding, and/or weaving/sewing the hair extensions to the hair. For example, using a needle and thread to sew/weave hair extensions to hair is one of the most popular forms of applying hair extensions. Threading a needle (e.g., a hair sewing needle, a hair weaving needle, etc.) to be used for hair extension applications, when performed manually, can be time-consuming. For example, a beautician and/or hairdresser may lack the manual dexterity required to navigate the end of a thread through the eye of a needle. The issue is exacerbated when multiple needles must be threaded at a rapid pace, such as within a hair salon and/or hairdresser environment. Hair salons are routinely overcrowded with delayed service due to the time required to thread needles for hair extension applications.

SUMMARY

It is to be understood that both the following general description and the following detailed description are exemplary and explanatory only and are not restrictive. Described are methods comprising receiving a supply of thread, receiving, at each needle receptacle of the plurality of needle receptacles, a needle of a plurality of needles, receiving, from the supply of thread, a portion of the thread, receiving a selection of a threader arm of a plurality of threader arms, wherein each threader arm is associated with a needle receptacle of the plurality of needle receptacles, and causing the selected threader arm to push the portion of the thread through an eye of the needle of the plurality of needles received at the needle receptacle of the plurality of needle receptacles that is associated with the selected threader arm.

Also described are methods comprising receiving a supply of thread, receiving, at each thread receptacle of a plurality of needle receptacles, a portion of thread from the supply of thread, wherein each thread receptacle of the plurality of needle receptacles is associated with a respective threader arm of a plurality of threader arms, receiving, at each needle receptacle of a plurality of needle receptacles, a needle of a plurality of needles, receiving an interaction with an interface, and causing based on the interaction, one or more threader arms of the plurality of threader arms to push the respective portion of the thread through an eye of the respective needle of the plurality of needles received at the needle receptacle of the plurality of needle receptacles that is associated with the selected threader arm.

Also described are methods comprising positioning, via a slotted receptacle, a portion of thread, positioning, via a needle receptacle, a portion of a needle, wherein the portion of the needle comprises an eye, receiving a selection of a threader arm of a plurality of threader arms, and causing, based on the selection, the threader arm to push the portion of the thread into the eye of the needle.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive.

BRIEF DESCRIPTION OF THE DRAWINGS

The accompanying drawings, which are incorporated in and constitute a part of this specification, together with the description, serve to explain the principles of the methods, systems, and apparatuses for threading needles.

DETAILED DESCRIPTION

Figure 1:
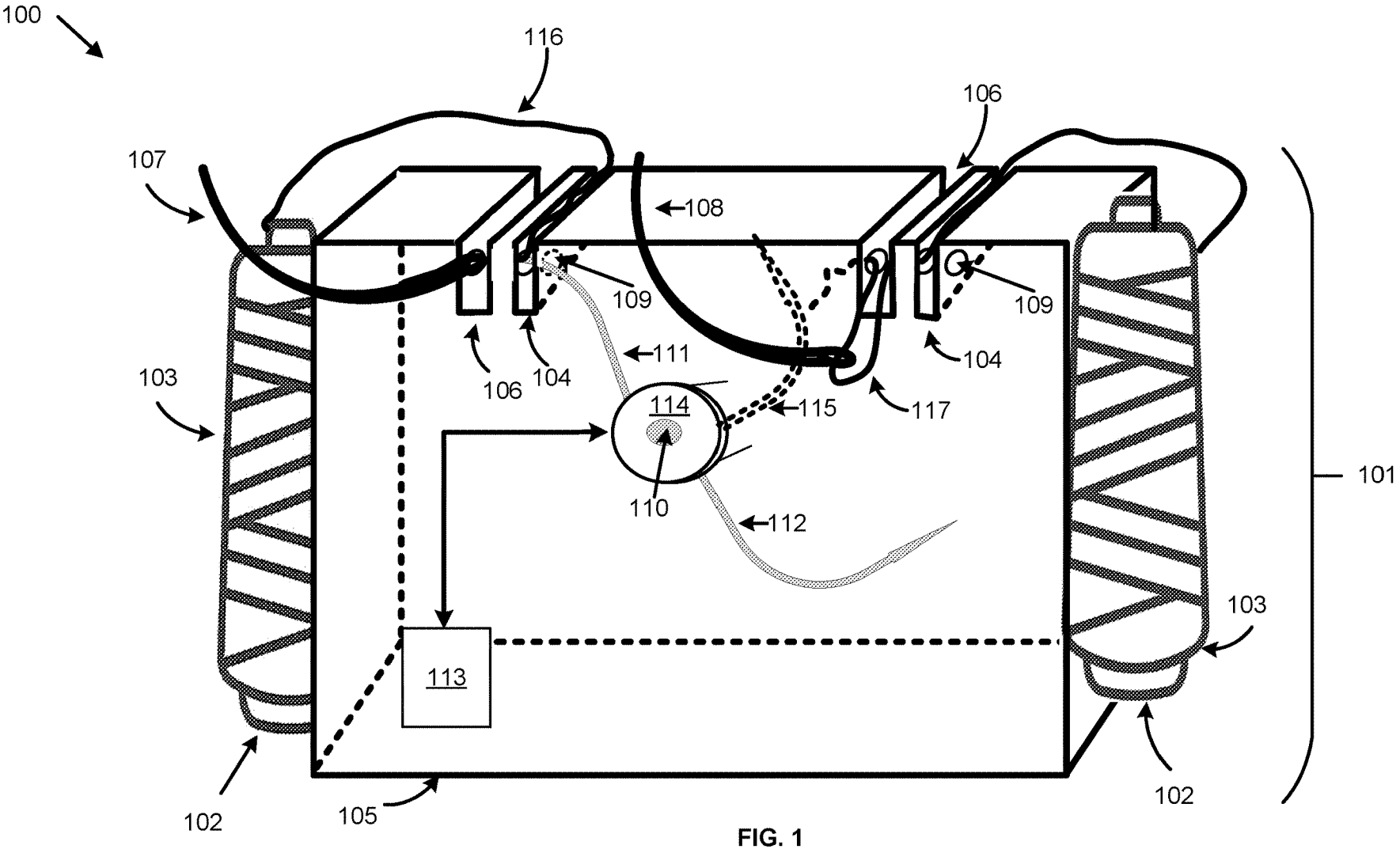
FIG. 1 shows a system for threading needles.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another configuration includes from the one particular value and/or to the other particular value. When values are expressed as approximations, by use of the antecedent "about," it will be understood that the particular value forms another configuration. It will be further understood that the endpoints of each of the ranges are significant both in relation to the other endpoint, and independently of the other endpoint.

"Optional" or "optionally" means that the subsequently described event or circumstance may or may not occur, and that the description includes cases where said event or circumstance occurs and cases where it does not.

Throughout the description and claims of this specification, the word "comprise" and variations of the word, such as "comprising" and "comprises," means "including but not limited to," and is not intended to exclude other components, integers or steps. "Exemplary" means "an example of" and is not intended to convey an indication of a preferred or ideal configuration. "Such as" is not used in a restrictive sense, but for explanatory purposes.

It is understood that when combinations, subsets, interactions, groups, etc. of components are described that, while specific reference of each various individual and collective combinations and permutations of these may not be explicitly described, each is specifically contemplated and described herein. This applies to all parts of this application including, but not limited to, steps in described methods. Thus, if there are a variety of additional steps that may be performed it is understood that each of these additional steps may be performed with any specific configuration or combination of configurations of the described methods.

As will be appreciated by one skilled in the art, hardware, software, or a combination of software and hardware may be implemented. Furthermore, a computer program product on a computer-readable storage medium (e.g., non-transitory) having processor-executable instructions (e.g., computer software) embodied in the storage medium. Any suitable computer-readable storage medium may be utilized including hard disks, CD-ROMs, optical storage devices, magnetic storage devices, memresistors, Non-Volatile Random Access Memory (NVRAM), flash memory, or a combination thereof.

Throughout this application reference is made to block diagrams and flowcharts. It will be understood that each block of the block diagrams and flowcharts, and combinations of blocks in the block diagrams and flowcharts, respectively, may be implemented by processor-executable instructions. These processor-executable instructions may be loaded onto a general-purpose computer, special purpose computer, or other programmable data processing apparatus to produce a machine, such that the processor-executable instructions which execute on the computer or other programmable data processing apparatus create a device for implementing the functions specified in the flowchart block or blocks.

These processor-executable instructions may also be stored in a computer-readable memory that may direct a computer or other programmable data processing apparatus to function in a particular manner, such that the processor-executable instructions stored in the computer-readable memory produce an article of manufacture including processor-executable instructions for implementing the function specified in the flowchart block or blocks. The processor-executable instructions may also be loaded onto a computer or other programmable data processing apparatus to cause a series of operational steps to be performed on the computer or other programmable apparatus to produce a computer-implemented process such that the processor-executable instructions that execute on the computer or other programmable apparatus provide steps for implementing the functions specified in the flowchart block or blocks.

Accordingly, blocks of the block diagrams and flowcharts support combinations of devices for performing the specified functions, combinations of steps for performing the specified functions and program instruction means for performing the specified functions. It will also be understood that each block of the block diagrams and flowcharts, and combinations of blocks in the block diagrams and flowcharts, may be implemented by special purpose hardware-based computer systems that perform the specified functions or steps, or combinations of special purpose hardware and computer instructions.

This detailed description may refer to a given entity performing some action. It should be understood that this language may in some cases mean that a system (e.g., a computer) owned and/or controlled by the given entity is actually performing the action.

A needle threading device (e.g., a needle threading device) may be configured to thread a plurality of needles (e.g., hair sewing needles, hair weaving needles, etc.). For example, the needle threading device can be configured to be loaded (e.g., manually loaded, automatically loaded, etc.) with needles and one or more spools of thread. The needle threading device may include one or more needle receptacles/holders that each holds a needle of the plurality of needles. For example, the one or more needle receptacles/holders may each hold a portion of a needle of a plurality of needles, such as a portion of a needle that includes an eye of the needle. Each needle receptacle of the plurality of needle receptacles may be associated with (e.g., configured in close proximity to, etc.) a slotted receptacle of a plurality of slotted receptacles that each hold a portion of thread from the one or more spools of thread. The needle threading device may receive a selection of one or more threader arms. For example, the needle threading device may include an interface that receives a selection and/or may be used to select the one more threader arms. Each threader arms of the plurality of threader arms may be associated with may be associated with (e.g., configured in close proximity to, etc.) a slotted receptacle of the plurality of slotted receptacles. The needle threading device may cause the selected one of more threader arms to insert the respective portion of the thread into the eye of the needle held by the needle receptacle associated with respective the slotted receptacle.

In some instances, the needle threading device may include a thread-catching member associated with each needle receptacle of the plurality of needle receptacles that pull the portion of the thread pushed into the eye of a needle to selectable lengths before cutting the thread from the one or more spools of thread.

FIG. 1 shows a system 100 for threading needles. A device 101 (e.g., a needle threading device) may be used to thread one or more needles, such as hair sewing/weaving needles, and/or the like. A frame 105 of the device 101 may be constructed from any hardened material, such as acrylic, polycarbonate, glass, plastic, wood, metal, and/or the like. For example, the frame 105 may be constructed from a transparent hardened material such as acrylic (Plexiglas®). The device 101 may include one or more attachments 102 configured to hold a supply of thread. The supply of thread may include one or more spools 103 of thread. The one or more attachments 102 may include one or more clip attachments, post attachments, magnetic attachments adhesive attachments, and/or the like configured to attach/secure the one or more spools 103 of thread to the device 101. Although only two attachments 102 are shown, the device 101 may include any number of attachments 102.

The device 101 may include one or more slotted receptacles 104. The slotted receptacles 104 may be configured to hold a portion of the thread, such as thread from the one or more spools 103 of thread and/or the like. Although only two slotted receptacles 104 are shown, the device 101 may include any number of slotted receptacles 104.

The device 101 may include one or more needle receptacles 106. Although only needle receptacles 106 are shown, the device 101 may include any number of needle receptacles 106. Each needle receptacle 106 may be configured to hold a different needle, such as a needle 107 and/or a needle 108. For example, the device 101 may include openings 109 (e.g., holes, portals, pathways, etc.) that extend through each needle receptacle 106 and a slotted receptacle 104, such as a slotted receptacle 104 configured nearby, associated with, and/or within proximity to a needle receptacle 106. Each needle receptacle 106 may be configured to hold a different needle such that an eye of the respective needle aligns with an opening 109.

The device 101 may include an interface 110. The interface 104 may be used to select one or more threader arms, such as a threader arm 111 and/or a threader arm 112. The device may include any number of threader arms. For example, a quantity of threader arms configured the device 101 may be equal to and/or based on a quantity of needle receptacles 106 and/or slotted receptacles 104 configured with and/or associated with the device 101. Each threader arm of the device 101 may be associated with a needle receptacle 106 and/or slotted receptacle 104 configured with and/or associated with the device 101. In some instances (as shown), the interface 110 may include a rotary dial. Interacting with the interface 110 may, such as turning the rotary dial, may be used to select and/or indicate a threader arm, such as the threader arm 111 and/or the threader arm 112. In some instances (not shown), the interface 110 may include a user interface (e.g., a graphical user interface, a touch screen, a keypad/buttons, etc.). Interacting with the interface 110 may, such as via the user interface, may be used to select and/or indicate a threader arm, such as the threader arm 111 and/or the threader arm 112.

The device 101 may include a control module 113 (e.g., processor, a module with processor-executable instructions embodied on computer-readable media, a smart component, a field-programmable gate array (FPGA), an application-specific integrated circuit (ASIC), etc.). The control module 113 may be configured to manage, control, and/or execute any signal, control, and/or process associated with the device 101. For example, the control module 113 may be in communication with and/or connected to the interface 110. The control module 113 may send data/information to and/or receive data/information from components of the device 101, such as the interface 110 and/or an activity module 114.

The activity module 114 may be in communication with and/or connected to the interface 110. The activity module 114 may send data/information to and/or receive data/information from the interface 101, such as a selection of a threader arm (e.g., the threader arm 111, the threader arm 112). The activity module 114 may be attached to, connected to, and/or house the threader arms (e.g., the threader arm 111, the threader arm 112) of the device 101. In some instances, the threader arms (e.g., the threader arm 111, the threader arm 112) of the device 101 may be retractable and may retract (e.g., recoils, readjust, etc.) to inside of the activity module 114, such as when a threader arm is not selected (via the interface 110). In some instances, the threader arms (e.g., the threader arm 111, the threader arm 112) of the device 101 may be configured in permanent positions (e.g., around a perimeter, at equally spaced locations, etc.) associated with the activity module 114.

The interface 110 may include an activation element/component (not shown), such as a start/activation interactive element (e.g., button, etc.), that when interacted with causes a selected threader arm to push thread through an eye of a needle. For example, when a threader arm is selected and the activation element/component is interacted with, the control module 113 may cause the activity module 114 to rotate. Rotation of the activity module 114 may cause a selected threader arm to rotate from a position. As shown, rotation of the activity module 114 causes the selected threader arm 111 to move from a position 115 (as indicated by the dotted silhouette of the threader arm 111). Based on the movement/rotation from the position, a portion of the threader arm 111 pushes a portion of thread 116 through an eye of the needle 107 via the opening 109. After the threader arm 111 pushes the portion of the thread 116 through the eye of the needle 107, the threader arm 111 may return to the position 115. For example, the activity module 114 may rotate in an opposite direction that causes the threader arm 111 to return to the position 115.

In some instances, when the activity module 114 may rotate to cause a selected threader arm to move from a position, the selected threader arm may extend from an internal cavity of the activity module 114. When the activity module 114 rotates in an opposite direction, it may cause the selected threader arm to return to a position and the threader arm may retract to the internal cavity of the activity module 114.

After the threader arm pushes the thread through an eye of a needle and the threader arm returns to a position, the needle may be removed from the device 101 as a threaded needle. For example, the threader arm 112 has pushed thread 117 through an eye of the needle 108. The threader arm 112 has been returned to a position and the needle 108 has been removed from the device 101 as a threaded needle.

Figure 2:
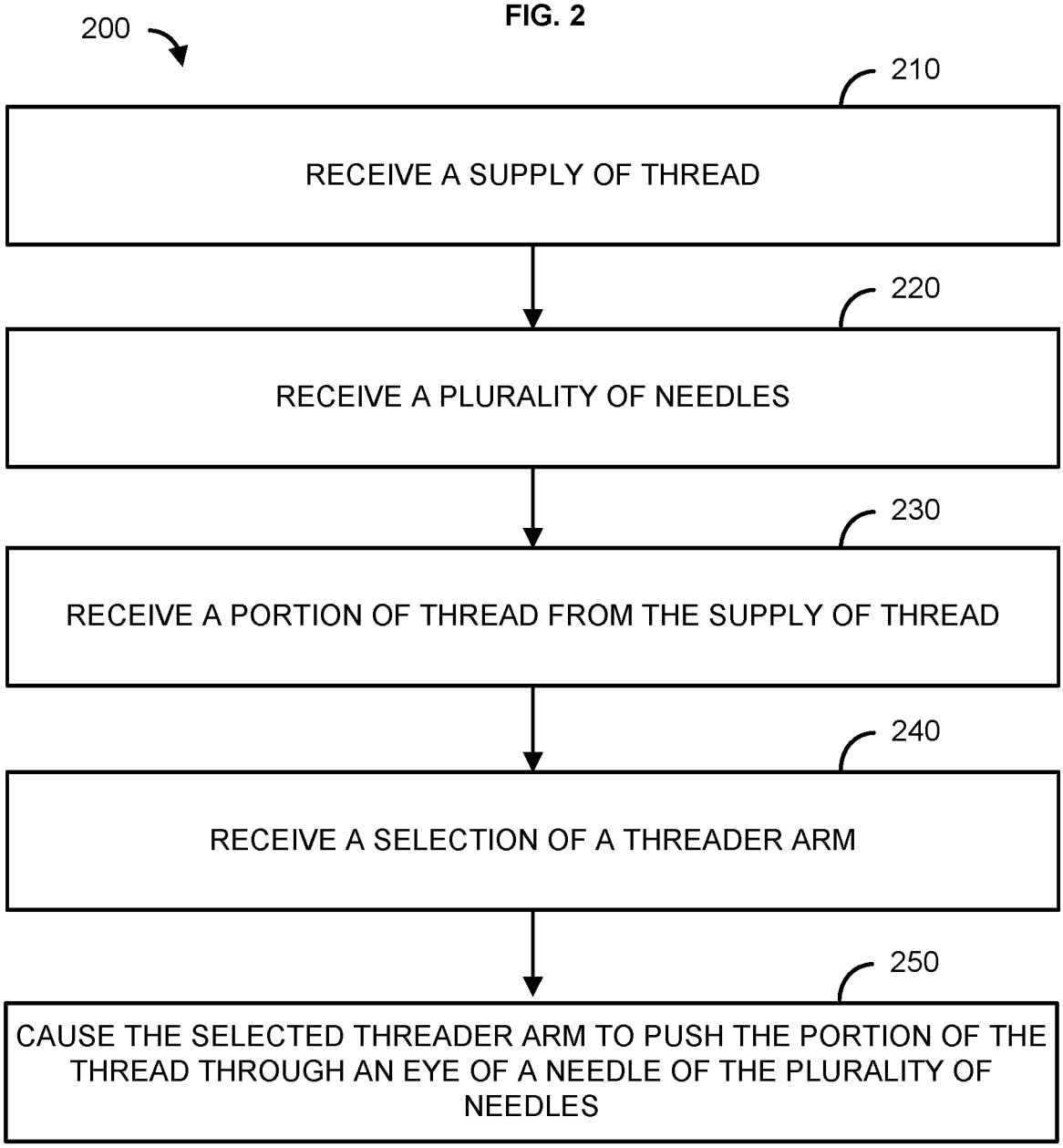
FIG. 2 shows a flowchart of a method for threading needles.

FIG. 2 shows a flowchart of a method 200 for threading needles. The system 100, and/or any other device/component described herein can be configured to perform the method 200 comprising, at 210, a supply of thread may be received. A needle threading device (e.g., a hair sewing needle threader, a hair weaving needle threader, the needle threading device 101, etc.) may receive the supply of thread. For example, the needle threading device may include attachments that may be loaded with and/or hold the supply of thread may include one or more spools of thread.

At 220, a plurality of needles may be received. The needle threading device may receive the plurality of needles. For example, the needle threading device may include and/or be configured with a plurality of needle receptacles. The needle threading device may receive, at each needle receptacle of the plurality of needle receptacles, a needle of a plurality of needles. In some instances, a user may position a needle in each needle receptacle of the needle threading device. In some instances, needles may be loaded into a dispenser associated with the needle threading device and the dispenser may dispense a needle to each needle receptacle of the needle threading device. The plurality of needles may include, for example, a plurality of hair weaving needles. A needle receptacle may hold a needle in place so that thread may be pushed through the eye of the needle.

At 230, a portion of a thread may be received. The needle threading device may receive a portion of the thread from the supply of thread. For example, the needle threading device may include and/or be configured with a plurality of slotted receptacles. In some instances, receiving the portion of the thread may include receiving the portion of the thread at a slotted receptacle of the plurality of slotted receptacles. In some instances, receiving the portion of the thread may include receiving, from the supply of thread, a different portion of the thread at each slotted receptacle of a plurality of slotted receptacles.

At 240, a selection of a threader arm may be received. The needle threading device may receive receiving a selection of a threader arm of a plurality of threader arms. For example, the needle threading device may include and/or be configured with a plurality of threader arms. Each threader arm may be associated with a needle receptacle of the plurality of needle receptacles. Receiving the selection of the threader arm may include receiving the selection via one or more of a rotary knob, or a user interface. For example, a rotary knob, a user interface, and/or the like may be used to select one or more threader arms of the plurality of threader arms. Selecting a threader arm may indicate which threader arm will be used to thread a needle of the plurality of needles.

At 250, thread may be pushed through the eye of a needle. The needle threading device may cause the selected threader arm to push the portion of the thread through an eye of the needle of the plurality of needles received at the needle receptacle of the plurality of needle receptacles that are associated with the selected threader arm. Causing the selected threader arm to push the portion of the thread through the eye of the needle may include, for example, causing the selected threader arm to rotate from a set position. Based on the rotation from the position, a portion of the threader arm may be caused to push the portion of the thread through an eye of the needle. Once the selected threader arm pushes the portion of the thread through the eye of the needle, the selected threader arm may return to the position. For example, the selected threader arm may return to the position to be ready to, if selected, push another portion of the thread through an eye of another needle.

Figure 3:
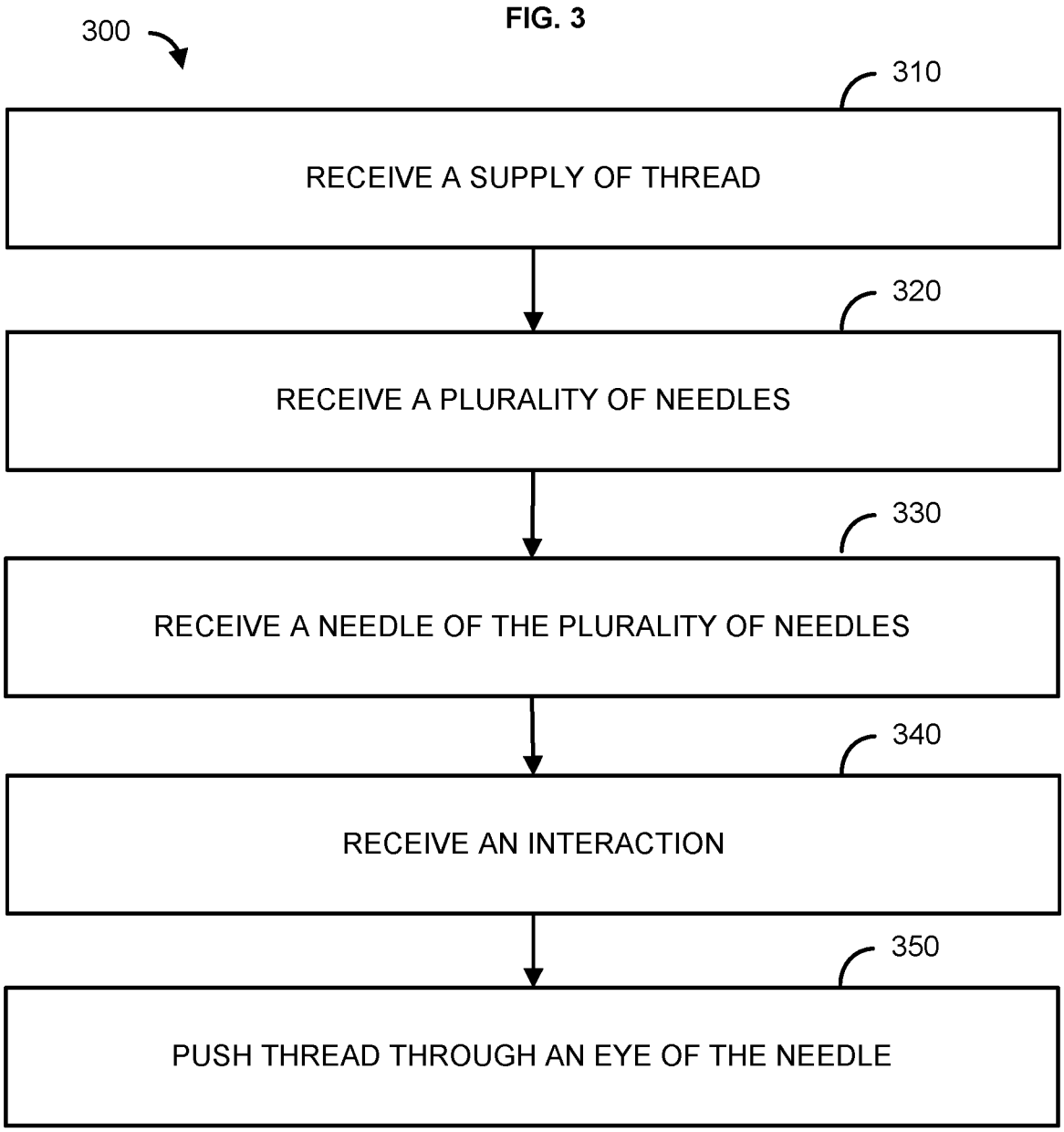
FIG. 3 shows a flowchart of a method for threading needles.

FIG. 3 shows a flowchart of a method 300 for threading needles. The system 100, and/or any other device/component described herein can be configured to perform the method 300 comprising, at 310, a supply of thread may be received. A needle threading device (e.g., a hair sewing needle threader, a hair weaving needle threader, the needle threading device 101, etc.) may receive the supply of thread. For example, the needle threading device may include attachments that may be loaded with and/or hold the supply of thread may include one or more spools of thread.

At 320, a plurality of needles may be received. The needle threading device may receive the plurality of needles. For example, the needle threading device may include and/or be configured with a plurality of needle receptacles. The needle threading device may receive, at each needle receptacle of the plurality of needle receptacles, a portion of thread from the supply of thread. The needle threading device may include and/or be configured with a plurality of threader arms. The needle threading device may be configured so that each needle receptacle of the plurality of needle receptacles is associated with a respective threader arm of a plurality of threader arms.

At 330, a needle of the plurality of needles may be received. The needle threading device may receive, at each needle receptacle of the plurality of needle receptacles, a needle of a plurality of needles. The plurality of needles may include, for example, a plurality of hair weaving needles. In some instances, a user may position a needle in each needle receptacle of the needle threading device. In some instances, needles may be loaded into a dispenser associated with the needle threading device and the dispenser may dispense a needle to each needle receptacle of the needle threading device. A needle receptacle may hold a needle in place so that thread may be pushed through the eye of the needle.

At 340, an interaction with an interface may be received. The needle threading device may receive interaction with an interface. For example, the interface may include a rotary knob, a user interface, a touch screen, a keypad, combinations thereof, and/or the like. The interaction may include a selection of the one or more threader arms. For example, a rotary dial may be turned to select the one or more threader arms. In some instances, an interactive element of a use interface may be interacted with to select the one or more threader arms.

At 350, thread can be pushed through a respective eye of one or more needles. The needle threading device may cause, based on the interaction, one or more threader arms of the plurality of threader arms to push the respective portion of the thread through an eye of the respective needle of the plurality of needles received at the needle receptacle of the plurality of needle receptacles that is associated with the selected threader arm. For example, causing the one or more threader arms to push the respective portion of the thread through the eye of the respective needle may include causing, based on the interaction, the one or more threader arms to each rotate from a respective position. Based on the one or more threader arms rotating from the respective positions, a portion of the one or more threader arms may push the respective portion of the thread through the eye of the respective needle. Once the one or more threader arms push the respective portion of the thread through the eye of the respective needle, the one or more threader arms may return to the respective positions.

Figure 4:
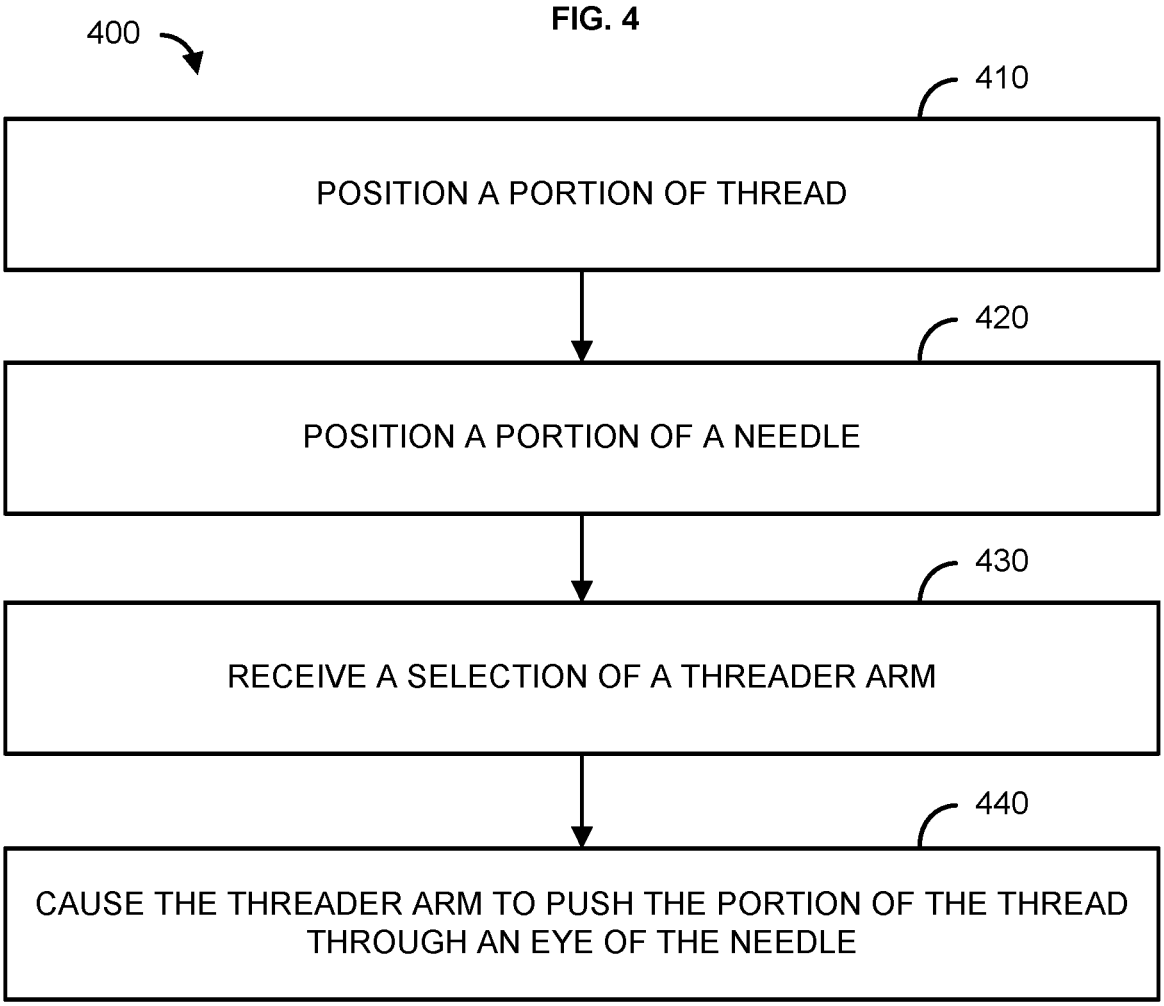
FIG. 4 shows a flowchart of a method for threading needles.

FIG. 4 shows a flowchart of a method 400 for threading needles. The system 100, and/or any other device/component described herein can be configured to perform the method 400 comprising, at 410, a portion of thread may be positioned within a slotted receptacle. A needle threading device (e.g., a hair sewing needle threader, a hair weaving needle threader, the needle threading device 101, etc.) may include and/or be configured with a plurality of slotted receptacles. Each slotted receptacle of the needle threading device may hold/position a portion of thread from a supply of thread. The needle threading device may include attachments that may be loaded with and/or hold the supply of thread. The supply of thread may include one or more spools of thread. In some instances, positioning a portion of the thread in a slotted receptacle of the needle threading device may include receiving the portion of the thread at each slotted receptacle of the plurality of slotted receptacles. In some instances, receiving the portion of the thread may include receiving, from the supply of thread, a different portion of the thread at each slotted receptacle of the plurality of slotted receptacles.

At 420, a portion of a needle may be positioned within a needle receptacle. For example, the needle threading device may include and/or be configured with a plurality of needle receptacles that may position/hold a portion of the needle, such as the eye of the needle, so that the eye aligns with a hole/portal of the needle threading device configured to receive a threader arm.

At 430, a selection of a threader arm may be received. The needle threading device may receive the selection of the threader arm. The needle threading device may include and/or be configured with a plurality of threader arms. The needle threading device may be configured so that each needle receptacle of the plurality of needle receptacles is associated with a respective threader arm of a plurality of threader arms. Receiving the selection of the threader arm may include receiving the selection via one or more of a rotary knob, or a user interface configured/associated with the needle threading device. For example, a rotary knob, a user interface, and/or the like may be used to select one or more threader arms of the plurality of threader arms. Selecting a threader arm may indicate which threader arm will be used to thread a needle of the plurality of needles.

At 440, thread may be pushed through the eye of a needle. The device may cause, based on the selection, the threader arm to push the portion of the thread into the eye of the needle.

In some instances, the method 400 may include positioning, via another slotted receptacle of the needle threading device, another portion of thread from the supply of thread. Positioning, via another needle receptacle of the needle threading device, a portion of another needle. A selection of another threader arm of the plurality of threader arms may be received and based on the selection, the needle threading device may cause the another threader arm to push the another portion of the thread into the eye of the another needle.

While the methods, systems, and apparatuses have been described in connection with different embodiments and specific examples, it is not intended that the scope be limited to the particular embodiments set forth, as the embodiments herein are intended in all respects to be illustrative rather than restrictive. Each embodiment described may incorporate all or portions of functions/components of any other embodiment described herein.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A method comprising:

receiving a supply of thread;

receiving, at each needle receptacle of a plurality of needle receptacles, a needle of a plurality of needles;

receiving, from the supply of thread, a portion of the thread;

receiving a selection of a threader arm of a plurality of threader arms via a rotation of a rotary knob about a rotational axis, wherein each threader arm is associated with a needle receptacle of the plurality of needle receptacles;

causing, based on the selection of the threader arm, the threader arm to rotate about the rotational axis from a retracted position to an extended position; and causing the selected threader arm to push the portion of the thread through an eye of the needle of the plurality of needles received at the needle receptacle of the plurality of needle receptacles that is associated with the selected threader arm.

2. The method of claim 1, wherein the supply of thread comprises one or more spools of thread.

3. The method of claim 1, wherein the plurality of needles comprises a plurality of hair sewing needles.

4. The method of claim 1, wherein receiving the portion of the thread comprises receiving the portion the thread at a slotted receptacle of a plurality of slotted receptacles.

5. The method of claim 1, wherein receiving the portion of the thread comprises receiving, from the supply of thread, a different portion of the thread at each slotted receptacle of a plurality of slotted receptacles.

6. The method of claim 1, wherein causing the selected threader arm to push the portion of the thread through the eye of the needle comprises:

causing, based on an interaction with an interactive element, the selected threader arm to rotate from a set position;

causing, based on the rotation from the set position, a portion of the selected threader arm to push the portion of the thread through the eye of the needle; and causing, based on the selected threader arm pushing the portion of the thread through the eye, the selected threader arm to return to the set position.

7. A method comprising:

receiving a supply of thread;

receiving, at each needle receptacle of a plurality of needle receptacles, a portion of thread from the supply of thread, wherein each needle receptacle of the plurality of needle receptacles is associated with a respective threader arm of a plurality of threader arms;

receiving, at each needle receptacle of the plurality of needle receptacles, a needle of a plurality of needles;

receiving an interaction with an interface, wherein the interaction with the interface comprises a rotation of a rotary knob about a rotational axis; and causing, based on the interaction, one or more threader arms of the plurality of threader arms to rotate about the rotational axis from a retracted position to an extended position and to push the respective portion of the thread through an eye of the respective needle of the plurality of needles received at the needle receptacle of the plurality of needle receptacles that is associated with the selected threader arm.

8. The method of claim 7, wherein the supply of thread comprises one or more spools of thread.

9. The method of claim 7, wherein the plurality of needles comprise a plurality of hair sewing needles.

10. The method of claim 7, wherein the interaction comprises a selection of the one or more threader arms.

11. The method of claim 7, wherein causing the one or more threader arms to push the respective portion of the thread through the eye of the respective needle comprises:

causing, based on the interaction, the one or more threader arms to each rotate from a respective position;

causing, based on the one or more threader arms rotating from the respective positions, a portion of the one or more threader arms to push the respective portion of the thread through the eye of the respective needle; and causing, based on the one or more threader arms pushing the respective portion of the thread through the eye of the respective needle, the one or more threader arms to return to the respective positions.

12. A method comprising:

positioning, via a slotted receptacle, a portion of thread;

positioning, via a needle receptacle of a plurality of needle receptacles, a portion of a needle, wherein the portion of the needle comprises an eye;

receiving a selection of a threader arm of a plurality of threader arms via a rotation of a rotary knob about a rotational axis, wherein each threader arm is associated with a needle receptacle of the plurality of needle receptacles; and causing, based on the selection of the threader arm, the threader arm to rotate about the rotational axis from a retracted position to an extended position; and causing the selected threader arm to push the portion of the thread into the eye of the needle.

13. The method of claim 12, further comprising receiving the portion of the thread from a supply of thread.

14. The method of claim 12, wherein the portion of the thread is received from a supply of thread, wherein the supply of thread comprises one or more spools of thread.

15. The method of claim 12, wherein the needle comprises a hair sewing needle.

16. The method of claim 12, wherein causing the threader arm to push the portion of the thread into the eye of the needle comprises:

causing the threader arm to rotate from a position;

causing, based on the rotation from the position, a portion of the threader arm to push the portion of the thread through the eye; and causing, based on the threader arm pushing the portion of the thread through the eye, the threader arm to return to the position.

17. The method of claim 12, further comprising:

positioning, via another slotted receptacle, another portion of thread;

positioning, via another needle receptacle, a portion of another needle, wherein the portion of the another needle comprises an eye;

receiving a selection of another threader arm of the plurality of threader arms; and causing, based on the selection, the another threader arm to push the another portion of the thread into the eye of the another needle.

* * * * *